US008136442B2

(12) United States Patent
Strutin-Belinoff et al.

(10) Patent No.: US 8,136,442 B2
(45) Date of Patent: Mar. 20, 2012

(54) SELECTION SYSTEMS AND METHODS

(75) Inventors: Pilar Ariella Strutin-Belinoff, Oakland, CA (US); Maxwell T. Abbott, Lantana, TX (US); James K. Pool, III, Frisco, TX (US); Michael J. Dobie, Double Oak, TX (US)

(73) Assignee: Turbochef Technologies, Inc., Atlanta, GA (US)

( * ) Notice: Subject to any disclaimer, the term of this patent is extended or adjusted under 35 U.S.C. 154(b) by 951 days.

(21) Appl. No.: 12/064,830

(22) PCT Filed: Aug. 30, 2006

(86) PCT No.: PCT/US2006/033553

§ 371 (c)(1),
(2), (4) Date: Apr. 15, 2008

(87) PCT Pub. No.: WO2007/027621

PCT Pub. Date: Mar. 8, 2007

(65) Prior Publication Data

US 2008/0229935 A1 Sep. 25, 2008

Related U.S. Application Data

(60) Provisional application No. 60/712,362, filed on Aug. 30, 2005.

(51) Int. Cl.

| | |
|---|---|
| ***A47J 37/00*** | (2006.01) |
| ***H01H 19/64*** | (2006.01) |
| ***H05B 6/68*** | (2006.01) |

(52) U.S. Cl. ..... 99/331; 99/339; 219/506; 219/680; 219/720

(58) Field of Classification Search ..... 99/325–327, 99/331, 332, 339; 219/391, 483, 506, 679–681, 219/702, 718–720, 725

See application file for complete search history.

(56) References Cited

U.S. PATENT DOCUMENTS

| | | | | | |
|---|---|---|---|---|---|
| 3,621,158 | A | * | 11/1971 | Swinstead | 200/308 |
| 3,827,345 | A | * | 8/1974 | Willson | 99/325 |
| 3,845,275 | A | * | 10/1974 | Branson | 99/332 |
| 3,965,322 | A | * | 6/1976 | Mori | 99/325 |
| 4,052,591 | A | * | 10/1977 | Sekera, Jr. et al. | 219/506 |
| 4,140,048 | A | * | 2/1979 | Grove et al. | 99/332 |
| 4,504,716 | A | * | 3/1985 | Sakamoto | 219/719 |
| 4,524,258 | A | * | 6/1985 | Aoki | 219/719 |
| 4,568,810 | A | * | 2/1986 | Carmean | 219/720 |
| 4,849,595 | A | * | 7/1989 | Fowler | 99/325 |
| 5,134,262 | A | * | 7/1992 | Lee | 99/325 |
| 5,317,134 | A | * | 5/1994 | Edamura | 219/720 |
| 5,345,067 | A | * | 9/1994 | Ohta et al. | 99/325 |

(Continued)

FOREIGN PATENT DOCUMENTS

| | | |
|---|---|---|
| CN | 1288130 | 3/2001 |

(Continued)

*Primary Examiner* — Stephen F Gerrity

(74) *Attorney, Agent, or Firm* — Dean W. Russell; Kristin M. Crall; Kilpatrick Townsend & Stockton LLP

(57) ABSTRACT

The present invention relates generally to a selection process that is facilitated by a multi-modality controller. The selection process and knob are particularly useful in connection with an oven or other cooking appliance, but the knob and screens described herein can be used with any electronic component that requires a user to select various operating modes.

20 Claims, 18 Drawing Sheets

U.S. PATENT DOCUMENTS

| | | | | | |
|---|---|---|---|---|---|
| 5,373,142 | A | * | 12/1994 | Ohshima et al. | 99/325 |
| 5,438,180 | A | * | 8/1995 | Eisenbrandt et al. | 219/506 |
| 5,558,796 | A | * | 9/1996 | Cho | 219/702 |
| 5,607,611 | A | * | 3/1997 | Lee | 219/702 |
| 5,693,245 | A | * | 12/1997 | Clizbe | 219/492 |
| 5,756,970 | A | * | 5/1998 | Barger et al. | 99/325 |
| 6,080,972 | A | * | 6/2000 | May | 99/325 |
| 6,337,469 | B1 | | 1/2002 | Chung | |
| 6,486,453 | B1 | | 11/2002 | Bales et al. | |
| 7,633,485 | B2 | * | 12/2009 | Reed et al. | 345/156 |
| 2007/0045284 | A1 | | 3/2007 | Balk | |
| 2008/0295702 | A1 | * | 12/2008 | Wiedemann et al. | 99/325 |

FOREIGN PATENT DOCUMENTS

| | | | | |
|---|---|---|---|---|
| CN | 1428551 | | | 7/2003 |
| DE | 10035642 | | | 12/2001 |
| EP | 0898003 | | | 2/1999 |
| EP | 1384951 | | | 1/2004 |
| GB | 2410541 | A | | 8/2005 |
| JP | 52005034 | A | * | 1/1977 |
| JP | 59035729 | A | * | 2/1984 |
| WO | WO 03/031876 | A1 | | 4/2003 |
| WO | WO 2005/026621 | A1 | | 3/2005 |
| WO | WO 2005/066547 | A2 | | 7/2005 |

* cited by examiner

| Oven | Food tree breadcrumb | | | | | | Generic Dish Name *(examples)* | Rules for Generic Naming |
|---|---|---|---|---|---|---|---|---|
| *Mode* | *Category* | *Type* | *Sub 1* | *Sub 2* | *Sub 3* | *Sub 4* | | |
| | | | | | | | | |
| **BAKE** | | | | | | | | |
| **Baked** | Baked goods | Bread | Fresh | | | | Baked Bread [Frozen] | omit mode (except bread) |
| | | Biscuits | Frozen | | | | Biscuits [Frozen] | category |
| | | Bars | | | | | Bars | type |
| | | Brownies | | | | | Brownies | [filled] |
| | | Cake | | | | | Cake | [frozen] |
| | | Cookies | | | | | Cookies | |
| | | Cupcakes | | | | | Cupcakes | |
| | | Custard | | | | | Custard | |
| | | Danish | Fresh | Fruit-filled | | | Danish [Fruit-filled] [Frozen] | |
| | | Desert Pie | Frozen | | | | Pie [Fruit-filled] [Frozen] | |
| | | Muffins | | | | | Muffins | |
| | | Pretzels | | | | | Pretzel Stuffed | |
| | | Rolls | | | | | Rolls [Frozen] | |
| | | | | | | | | |
| | Meats/Poultry | Meatloaf | Whole | Fresh | | lbs | Baked Meatloaf | mode |
| | | Poultry | Portions | Frozen | stuffed | | Baked Poultry [stuffed] | Baked Poultry [stuffed] |
| | | | | | | | | type |
| | | | | | | | | [stuffed] |
| | | | | | | | | |
| | Pizza | Thick crust | Fresh | Regular | inches | | Thickcrust Pizza 8in [Frozen] | type |
| | | Thin crust | Frozen | Self-rising | | | Thincrust Pizza 12in [Frozen] | pizza (pizza only) |
| | | Pan | | | | | Pan Pizza 10in [Frozen] | diameter |
| | | Stuffed | | | | | Stuffed Pizza 8in [Frozen] | [stuffed] |

⋮ ⋮ ⋮ ⋮ ⋮ ⋮

*(Figure 5A-2)*
↓

Figure 5A-1

↑ (Figure 5A-1)

| | | | | | | | | |
|---|---|---|---|---|---|---|---|---|
| | | Stromboli | | | | | Stromboli Pizza | [frozen] |
| | | Calzone | | Stuffed | | | Calzone [Stuffed] [Frozen] | |
| | | | | | | | | |
| | Pasta | Lasagna | Fresh | | | | Baked Lasagna | mode |
| | | Macaroni | Frozen | | | | Baked Macaroni | type |
| | | Tortellini | | | | | Baked Tortellini [Frozen] | [stuffed] |
| | | Ziti | | | | | Baked Ziti [Frozen] | [frozen] |
| | | etc... | | | | | | |
| | Casserole/Prepared Meal | Casserole | Fresh | Stuffed | | | Baked [Stuffed] Casserole | mode (baked) |
| | | Entree | Frozen | Empty | | | Baked Entree [Frozen] | [stuffed] |
| | | Dinner | | | | | Baked Dinner [Frozen] | type |
| | | Frittata | | | | | Baked Frittata [Frozen] | [frozen] |
| | | Pot Pies | | | | | Baked Pot Pie [Frozen] | |
| | | Hamburger | Fresh | | | | Hamburger [Frozen] | omit mode (hamburger/hotdog) |
| | | Hot Dog | Frozen | | | | Hot Dog [Frozen] | omit category |
| | | | | | | | | type |
| | | | | | | | | [frozen] |
| | | | | | | | | |
| | Seafood | Fish Steak | Fresh | | lbs | | Baked Fish Steak [Frozen] | mode (baked) |
| | | Fillet | Frozen | | | | Baked Fillet [Frozen] | omit category |
| | | Shellfish | | | | | Baked Shellfish [Frozen] | type |
| | | Shrimp | | | | | Baked Shrimp [Frozen] | [frozen] |
| | | | | | | | | |
| | Vegetables | Assorted Vegetables | Fresh | | | | Baked Assorted Vegetables [Frozen] | mode (Baked or Roasted) |
| | | Beans | Frozen | | | | Baked Beans | omit category |
| | | Beets | | | | | Baked Beets | type |
| | | Carrot | | | | | [Baked/Roasted] Carrots [Frozen] | [frozen] |
| | | Onions | | | | | [Baked/Roasted] Onions | |

Figure 5A-2

| **Oven** | **Food tree breadcrumb** | | | | | | **Generic Dish Name** *(examples)* | **Rules for Generic Naming** |
|---|---|---|---|---|---|---|---|---|
| *Mode* | *Category* | *Type* | *Sub 1* | *Sub 2* | *Sub 3* | *Sub 4* | | |
| | | | | | | | | |
| | (vegetables continued) | Eggplant | Empty | | | | Baked [Stuffed] Eggplant | |
| | | Mushrooms | Stuffed | | | | Baked [Stuffed] Mushrooms | |
| | | Peppers | | | | | [Baked/Roasted] [Stuffed] Peppers | |
| | | Tomatoes | | | | | Baked [Stuffed] Tomatoes | |
| | | Zucchini | | | | | Baked Zucchini | |
| | | | | | | | | |
| | | Potatoes | S/M/L | Whole | lbs | | [Baked/Roasted] [S,M,L] Potatoes | mode (Baked or Roasted) |
| | | Pumpkin | | Halves | | | Baked Pumpkin | |
| | | Squash | | Wedges | | | Baked Squash | |
| | | Sweet Potato | | Slices | | | [Baked/Roasted] Sweet Potatoes | |
| | | Yams | | | | | Baked Yams | |
| | | | | | | | | |
| **ROAST** | | | | | | | | |
| **Roasted** | Meat | Beef | Roast | Rare | inches | lbs | Roast Beef Med-rare | mode |
| | | Game | Steak | Med-rare | | | Roasted Lamb Chop Med | omit category |
| | | | | Med | | | Roasted Veal Med-well | meat type |
| | | Lamb | Roast | Med-well | | | Roasted Pork Chop Well-done | roast/steak/chop |
| | | Pork | Chop | Well-done | | | | doneness |
| | | Veal | | | | | | |
| | | | | | | | | |
| | Poultry | *Chicken* | Whole | Fresh | Stuffed | lbs | Roasted Chicken [Stuffed] [Whole/Portions] | mode (Roasted) |
| | | *Duck* | Portions | Frozen | Unstuffed | | Roasted Duck | omit category |
| | | *Goose* | | | | | Roasted Goose | poultry type |
| | | *Hen* | | | | | Roasted Hen | [stuffed] |
| | | *Turkey* | | | | | Roasted Turkey | whole/portions |

⋮ ⋮ ⋮ *(Figure 5B-2)* ↓ ⋮ ⋮ ⋮

Figure 5B-1

↑
(Figure 5B-1)

| | | | | | | | | |
|---|---|---|---|---|---|---|---|---|
| | Vegetables? | Assorted Veg | Fresh | | lbs | | Roasted Assorted Vegetables [Frozen] | *same as baked veggies?* |
| | | Carrots | Frozen | | | | Roasted Carrots | |
| | | Onions | | | | | Roasted Onions | |
| | | Peppers | | | | | Roasted Peppers | |
| | | Potatoes | | | | | Roasted Potatoes | |
| | | Sweet Potatoes | | | | | Roasted Sweet Potatoes | |
| | | | | | | | | |
| **BROIL** | | | | | | | | |
| **Broiled** | Meat | Beef | Fresh | Rare | inches | lbs | Broiled Beef Med-Rare | mode (Broiled) |
| | | Game | Frozen | Med-rare | | | Broiled Game Well-done | omit category |
| | | Lamb | | Med | | | Broiled Lamb Med-Rare | meat type |
| | | Pork | | Med-well | | | Broiled Pork Well-done | doneness |
| | | Rabbit | | Well-done | | | Broiled Rabbit Med-well | |
| | | Veal | | | | | Broiled Veal Med-Rare | |
| | | | | | | | | |
| | Poultry? *(repeat Roast?)* | *Chicken* | Whole | Fresh | Stuffed | lbs | Broiled Chicken [Stuffed] [Whole/Portions] | mode (Broiled) |
| | | *Duck* | Portions | Frozen | Unstuffed | | Broiled Duck [Stuffed] | omit category |
| | | *Goose* | | | | | Broiled Goose [Stuffed] | Poultry type |
| | | *Hen* | | | | | Broiled Hen [Stuffed] | [stuffed] |
| | | *Turkey* | | | | | Broiled Turkey [Stuffed] | whole/portions |
| | | | | | | | | |
| | Seafood | Fish Steak | Fresh | | lbs | | Broiled Fish Steak [frozen] | mode (Broiled) |
| | | Fillets | Frozen | | | | Broiled Fillets [frozen] | |
| | | Shellfish | | | | | Broiled Shellfish [frozen] | |
| | | Shrimp | | | | | Broiled Shrimp [frozen] | |
| | | | | | | | | |
| | | | | | | | | |

Figure 5B-2

| Oven | Food tree breadcrumb | | | | | | Generic Dish Name *(examples)* | Rules for Generic Naming |
|---|---|---|---|---|---|---|---|---|
| *Mode* | *Category* | *Type* | *Sub 1* | *Sub 2* | *Sub 3* | *Sub 4* | | |
| | | | | | | | | |
| **AIR CRISP** | | | | | | | | |
| **Air Crisp** | | Appetizers | Stuffed | Fresh | quantity | | Appetizers [Stuffed] [Cheese] [Frozen] | omit mode |
| | | Cheese Appetizers | Empty | Frozen | | | Appetizers | omit category |
| | | Chicken Tenders | | | | | | type |
| | | Chicken Wings | | | | | | [stuffed] |
| | | Egg Rolls | | | | | | [frozen] |
| | | Fish Tenders | | | | | | |
| | | French Fries | | | | | | |
| | | Mozzarella Sticks | | | | | | |
| | | | | | | | | |
| **TOAST** | | | | | | | | |
| **Toasted** | Breads | Bagel | Fresh | | | | Toasted Bagel | mode (Toasted) |
| | | Bread | Frozen | | | | Toasted Bread | omit category if bread |
| | | Focaccia | | | | | Toasted Focaccia | type |
| | | Roll | | | | | Toasted Roll | |
| | Pastry | | | | | | Toasted Pastry | |
| | | | | | | | | |
| | Sandwich | Cheese Melt | Fresh | | quantity | | Cheese Melt 4 | omit mode |
| | | Cheese and Meat | Frozen | | | | Cheese and Meat Sandwich | type |
| | | Chicken | | | | | Chicken Sandwich 2 | category (Sandwich) |
| | | Meat | | | | | Meat Sandwich | [quantity] |
| | | Vegetable | | | | | Vegetable Sandwich 3 | [frozen] |
| | | | | | | | | |
| | | | | | | | | |
| **DEHYDRATE** | | | | | | | | |
| | | | | | | | | |
| **Dried** | Fruits | *fruit list* | Fresh | | lbs | | Dried [Apricots] [frozen] | mode (Dried) |
| | Meat/Poultry | *meat list* | Frozen | | | | Dried [Turkey Strips] | category |
| | Vegetables | *veggies list* | | | | | Dried [Tomatoes] | [frozen] |

Figure 5C

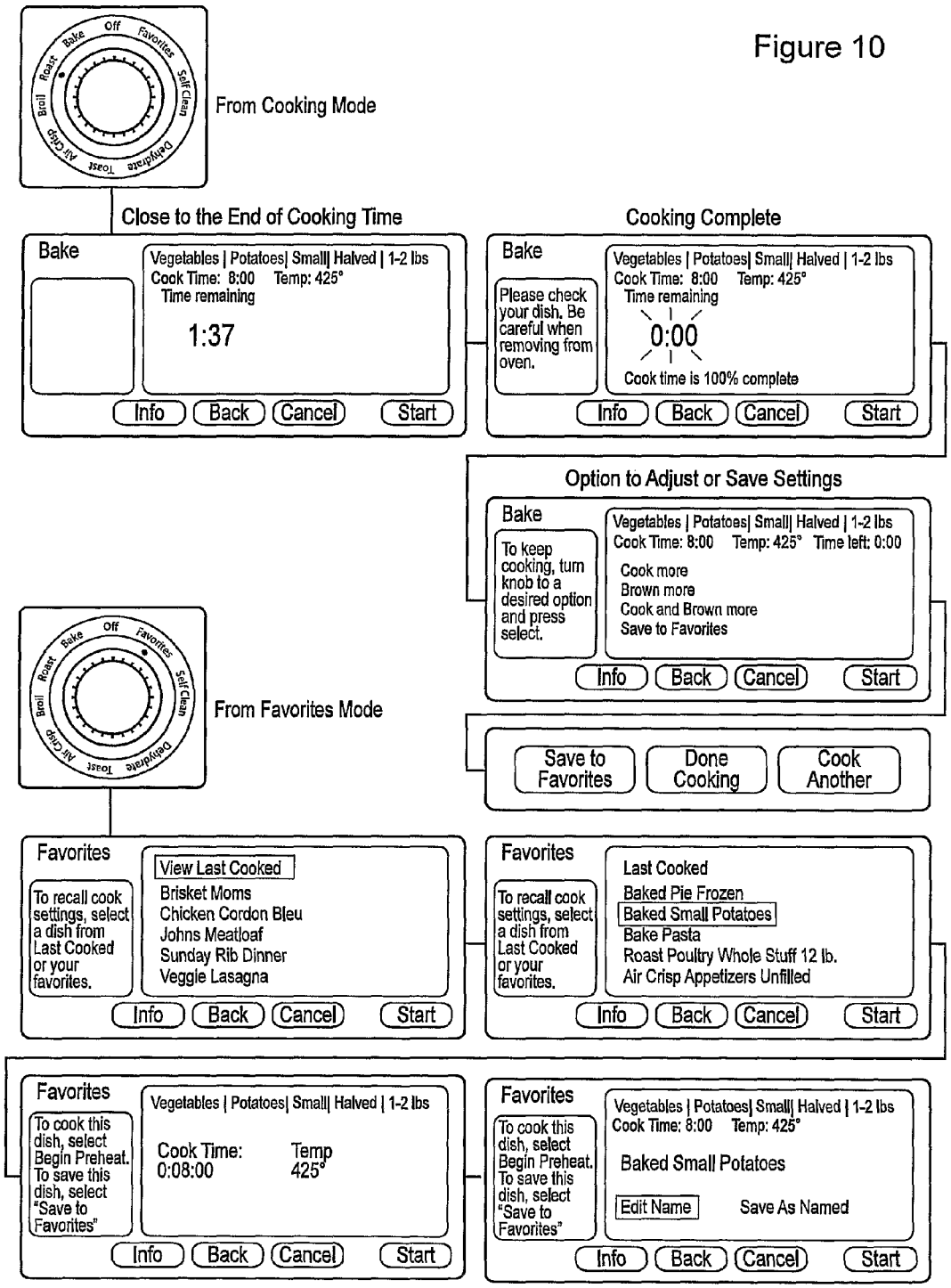
Figure 10
Off
Favorites
Bake
Roast
Broil
Self Clean
Dehydrate
Toast
Air Crisp
From Cooking Mode
Close to the End of Cooking Time
Bake
Vegetables | Potatoes| Small| Halved | 1-2 lbs
Cook Time: 8:00 Temp: 425°
Time remaining
1:37
Info
Back
Cancel
Start
Cooking Complete
Bake
Please check your dish. Be careful when removing from oven.
Vegetables | Potatoes| Small| Halved | 1-2 lbs
Cook Time: 8:00 Temp: 425°
Time remaining
0:00
Cook time is 100% complete
Info
Back
Cancel
Start
Option to Adjust or Save Settings
Bake
To keep cooking, turn knob to a desired option and press select.
Vegetables | Potatoes| Small| Halved | 1-2 lbs
Cook Time: 8:00 Temp: 425° Time left: 0:00
Cook more
Brown more
Cook and Brown more
Save to Favorites
Info
Back
Cancel
Start
Save to Favorites
Done Cooking
Cook Another
From Favorites Mode
Favorites
To recall cook settings, select a dish from Last Cooked or your favorites.
View Last Cooked
Brisket Moms
Chicken Cordon Bleu
Johns Meatloaf
Sunday Rib Dinner
Veggie Lasagna
Info
Back
Cancel
Start
Favorites
To recall cook settings, select a dish from Last Cooked or your favorites.
Last Cooked
Baked Pie Frozen
Baked Small Potatoes
Bake Pasta
Roast Poultry Whole Stuff 12 lb.
Air Crisp Appetizers Unfilled
Info
Back
Cancel
Start
Favorites
To cook this dish, select Begin Preheat. To save this dish, select "Save to Favorites"
Vegetables | Potatoes| Small| Halved | 1-2 lbs
Cook Time: 0:08:00
Temp 425°
Info
Back
Cancel
Start
Favorites
To cook this dish, select Begin Preheat. To save this dish, select "Save to Favorites"
Vegetables | Potatoes| Small| Halved | 1-2 lbs
Cook Time: 8:00 Temp: 425°
Baked Small Potatoes
Edit Name
Save As Named
Info
Back
Cancel
Start

SELECTION SYSTEMS AND METHODS

CROSS REFERENCE TO RELATED APPLICATION

This application is the U.S. national phase of International Application No. PCT/US2006/033553 filed on Aug. 30, 2006 and published in English on Mar. 8, 2007 as International Publication No. WO 2007/027621 A2, which application claims priority to U.S. Provisional Application No. 60/712,362 filed on Aug. 30, 2005, the contents of which are incorporated herein by reference.

FIELD OF THE INVENTION

The present invention relates to knobs and controllers for use with electronic devices to quickly and easily present choices to users.

BACKGROUND

Many cooking appliances incorporate electronic controls that allow the user to specify desired cooking parameters to a more precise degree. For example, ovens, ranges, and microwaves have been developed to incorporate programmable features that allow a user to input certain cooking information, such as cooking modes, weights, times, and temperatures. For instance, some microwaves invite the user to input what is being cooked, whether it is being defrosted or not, and how much the item weighs. This allows the microwave to deliver the proper amount of energy to perform the programmed cooking operation.

There have also been other advances in oven technology. For example, ovens are being designed that are able to use more than one energy source to cook food, particularly in the commercial setting. (Examples of such ovens are shown and described by U.S. Pat. Nos. 5,958,274 and 6,486,453, the entire contents of each of which are incorporated here by reference.) In other words, whereas most ovens cook using one form of energy, e.g., a stove top, a range, a microwave, or a toaster oven, many commercial ovens have been developed that use, for example, both hot air convention and microwave energy to cook a food item much more rapidly. Such ovens may be referred to in this document as rapid cook ovens, speed cook ovens, or multi-energy source ovens. The use of varied energy sources allows the oven to use the combination of energy to cook food quickly, but without sacrificing taste and quality.

For example, there may be instances when steaming can be used in connection with a convention oven. Such ovens can steam and bake at the same time—anywhere from seconds to minutes. However, these ovens are not necessarily optimized to a residential setting. They are also often designed for the particular food being cooked and/or they are provided with a limited number of options that relate to the food item to be cooked, e.g., steam and/or convention cook an item, so there is typically minimal adjusting that needs to be done in the commercial setting. However, because residential ovens that use more than one energy source are expected to become more common in the future, allowing homeowners to bake casseroles, roast turkeys, and broil chicken much more quickly, there is a need for a more user-friendly interface that allows for a variety of cooking options. The options should not be reminiscent of their commercial counterparts, but should provide a sophisticated, yet user-friendly, screen and interface.

There is accordingly a need for a system that prompts the user to input certain cooking information, a screen that only offers options that relate to the previous choices that have been made, a knob or other controller that allows the selection process to be simple, and an oven than can then control the cooking appliance to perform the desired operation. There is also a need for a system that allows a user to change cooking options once cooking recommendations have been made, a system that prompts the user to check the food once cooking is nearing completion to allow for any alterations to the cooking parameters that may need to be made, and a system that allows the user to save specific cooking instructions that have been altered from the recommended settings. There is a further need for an oven that can download additional cooking parameters, recipes, or changes from a multitude of sources (e.g., from a manufacturer's website) via a multitude of communication methods (e.g., wireless, internet, bluetooth, wired communication, or in any other way that devices may communicate.) It may also be desirable to provide a feature that allows a user to upload information from his/her oven to a website, a disc, or any other information holding device or area.

SUMMARY

The present invention relates generally to a selection process that is facilitated by a multi-modality knob or controller. The selection process and controller are particularly useful in connection with an oven or other cooking appliance, but the controller and screens described herein can be used with any electronic component that requires a user to select various operating modes.

BRIEF DESCRIPTION OF THE DRAWINGS

FIGS. 5A-5C show examples of various sub-selections that may be made using a controller according to one embodiment of the present invention.

FIGS. 10 and 11 show various examples of how to save favorite cooking settings.

DETAILED DESCRIPTION OF THE DRAWINGS

Certain embodiments of the present invention relate to a system for programming and operating a cooking appliance, preferably a cooking appliance that uses multiple sources of energy to cook food. The cooking appliance will provide a recommended cooking time, temperature, air velocity (top and bottom), and microwave power based on parameters inputted by the user. A menu-driven display and a multi-modality controller are used to step a user through a series of prompts, ranging from the type of cooking to be performed, the relevant food groups that can be cooked using the selected method, and sub-categories that can be chosen, such as fresh or frozen, whole or parts, regular or self-rising, stuffed or empty. These sub-categories depend upon the type of food to be cooked.

Figures 1A, 1B:
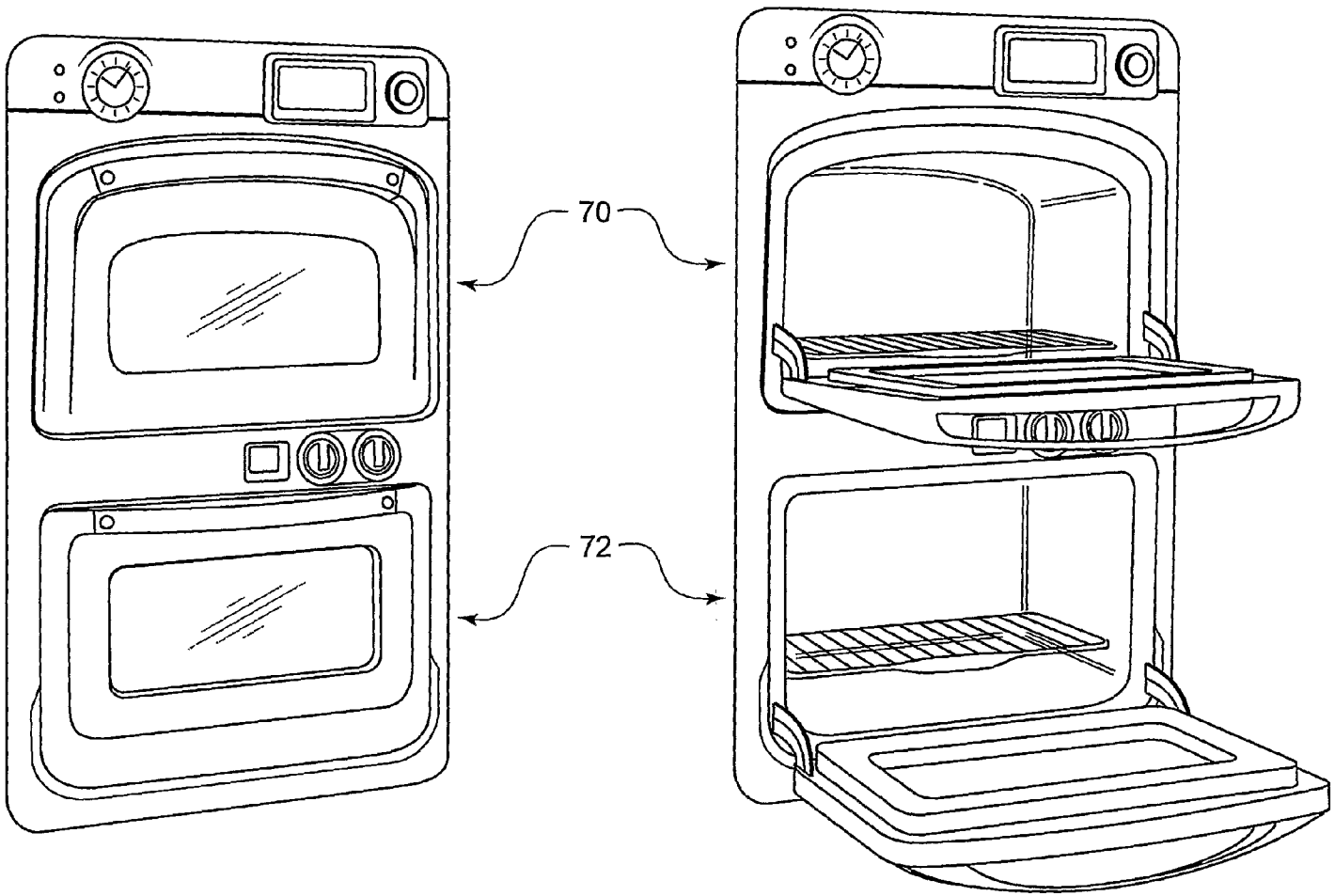
FIGS. 1A and 1B show examples of a multi-energy source oven and a conventional or traditional oven that may be stacked.

As shown in FIG. 1, the multi-energy source oven 70 may be combined with a conventional oven 72 and/or other devices in order to save space and to allow homeowners a number of versatile options. It has become increasingly popular for homeowners to have two ovens so that casseroles and main dishes can be cooked simultaneously, and embodiments of the present invention provide more cooking options and a greater ability for homeowners to time their meals so that all dishes are ready at once. However, various ovens described herein may also be used as stand-alone ovens.

Figure 2:
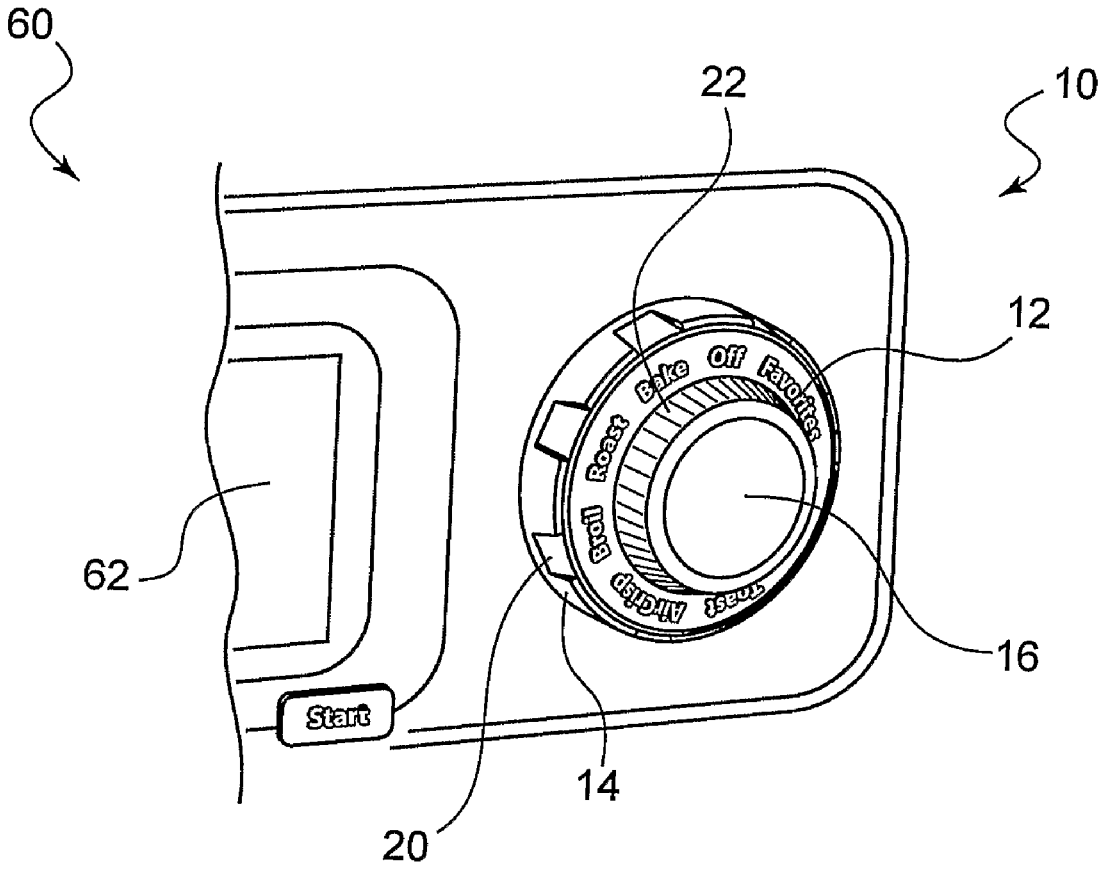
FIG. 2 shows a multi-modality controller according to one embodiment of the present invention.
Figure 4A:
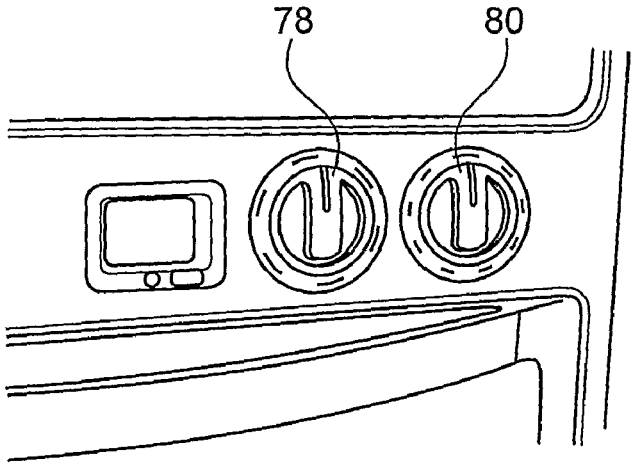
FIGS. 4A-4C show examples of conventional oven knobs.
Figure 4B:
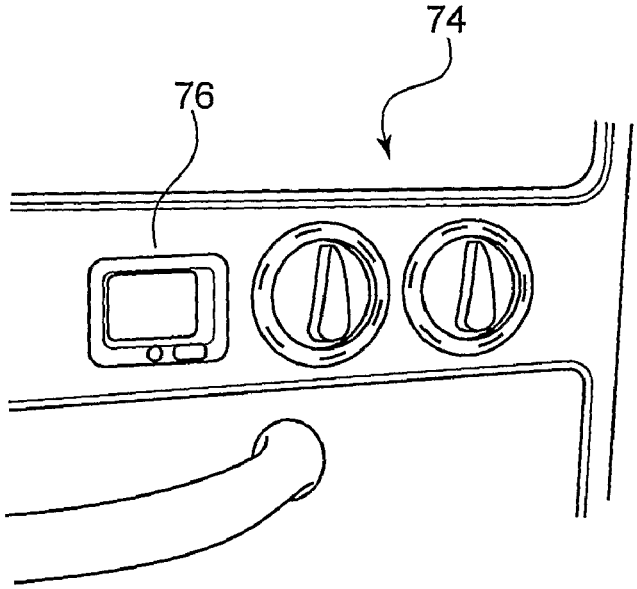
Figure 4C:
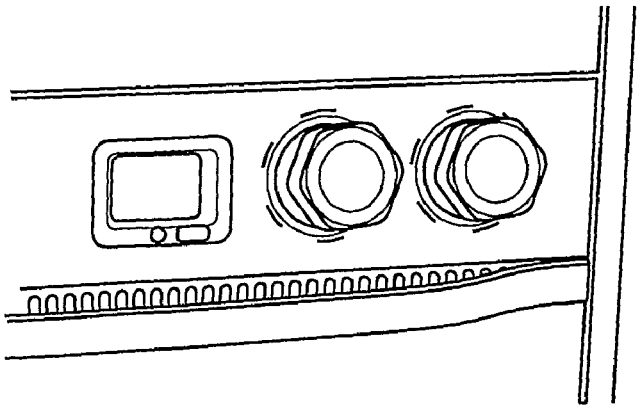

A particular embodiment of the invention relates to a user interface 60 that is accessed via a multi-modality controller 10, shown in FIG. 2. The controller may be provided as a knob, as a touch pad, as a thumb wheel, or any other device that allows a user to make a selection. The multi-modality controller 10 is designed to help facilitate an uncluttered and easy way to access the user interface 60. It provides the user access to a variety of detailed menu options and systems to enable quick and easy decision-making. The multi-modality controller is particularly preferred for use with the multi-energy source oven 70 because, as described below, such ovens 70 offer a series of options in addition to the way the food will be cooked and at what temperature. (Example of conventional oven knobs 74 and screens 76 are shown in FIGS. 4A-4C. These examples show a cook-type knob 78 for selecting bake, roast, broil, microwave, convection cook, self clean, etc. and a temperature knob 80 for setting the cooking temperature.)

Figure 3:
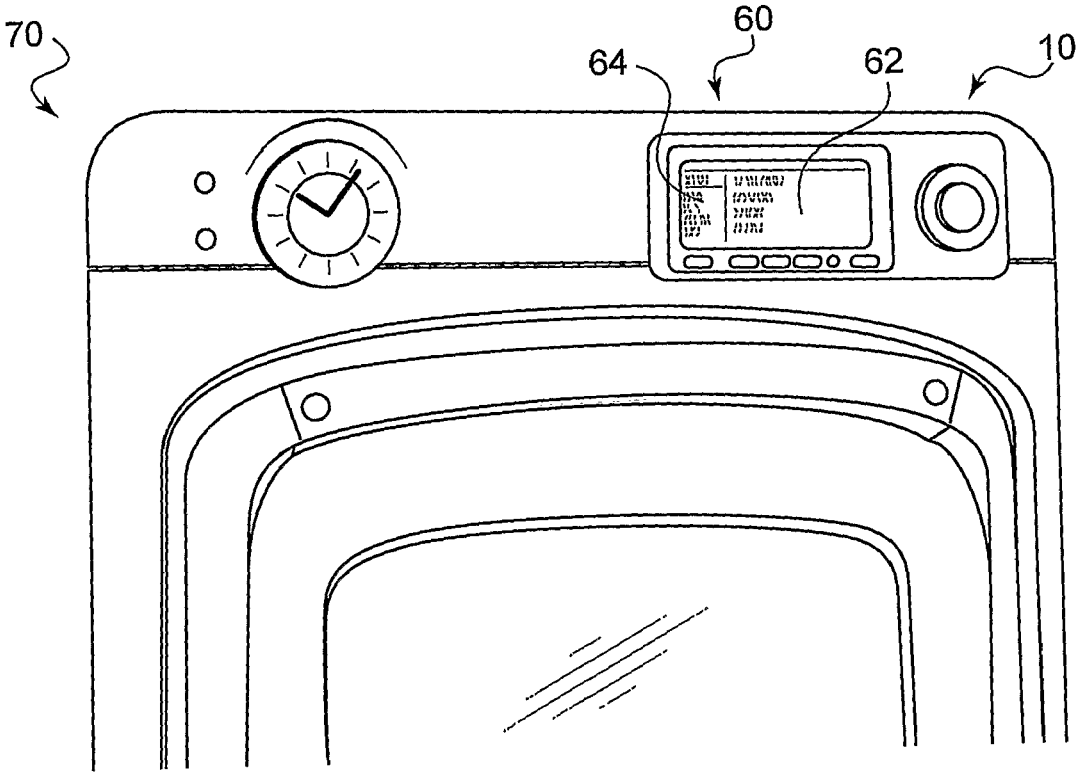
FIG. 3 shows a close up of a user interface and controller according to various embodiments of the present invention.

Referring to FIG. 3, the multi-energy source oven 70 is shown having a controller 10 and an interface 60. In certain embodiments, the interface 60 area may be tilted downwards a few degrees to allow viewing for shorter users or to reduce glare. There is also preferably provided glass 64 with an anti-glare coating over the screen 62 to protect the screen, to allow it to be easily cleaned, and to provide resistance to stains or solvents.

Referring back to FIG. 2, one embodiment of controller 10 may have two rotating sections, such as an inner wheel 12 and an outer wheel 14. Inner and outer wheels may be nested within one another (as shown) or they may be separately positioned. It should be understood, however, that the controller 10 may have three, four, or any other number of wheels, selection methods, or modalities. The inner, outer, or side parts of each wheel may be backlit or otherwise allowed to glow. The outer wheel 14 allows the user to select a "level one" choice. In the oven example, this could be a specific cook mode, such as roast bake, broil, air crisp, defrost, reheat, toast, self-clean, favorites, and so forth. The outer wheel 14 may have macro-sculpting 20 around the perimeter that echoes the internal detents that the user will feel as the controller is turned. This sculpting 20 is provided to give the user traction for rotating outer wheel 14.

The inner wheel 12 is a touch-sensitive scroll wheel that has a scrolling mechanism for scrolling the selections on the display screen 62. In keeping with its fine movements, it preferably has small, fine internal detents that are echoed by a fine rib texture 22 on the outer part of the wheel. The scroll function is preferably defaulted to work from the left to the right of the screen. The inner wheel 12 allows the user to access menu options on the display screen 62 that relate to the sub-selections of the choice made at "level one."

For example, in the oven example, the user could use the inner wheel 12 to select what type of food is to be cooked. This could be considered a "level two" choice. If the user selected "bake" at level one, only foods that can be baked are provided as level two choices, e.g., options from which to select using the inner wheel 12. (For the ease of this description, the outer wheel 14 will be described as the wheel used to make the "level one" choice and the inner wheel 12 will be described as the wheel used to make the "level two" choice and subsequent sub-selections. However, it should be understood that the inner wheel 12 could be used to make the "level one" choice and the outer wheel 14 could be used to make the "level two" and subsequent choices.)

The wheels are preferably attached to one another, but are allowed to be independently rotatable about a central axis. They are preferably coaxial, with one wheel circumscribing the other, and with both wheels sharing a common axis. In a particular embodiment, the outer wheel 14 has a larger circumference than the inner wheel 12, and the inner wheel 12 may sit within an indentation or groove on the inner surface of the outer wheel 14, although it should be allowed to rotate independently.

In some embodiments, there may be provided an inner button 16 on the inner wheel 14 (or inside the inner wheel, if the inner wheel is a disc rather than a solid wheel). The inner button 16 may be a rubber membrane that is pushed to select on-screen items. It may also pulse or light up when an action or input is required. The button 16 may be depressed to make a selection, similar to the way that a computer user would click a mouse button to make a selection. In other embodiments, the inner wheel 12 itself may be depressed to make the selection. By depressing the inner button 16 or the inner wheel 12 once the inner wheel 12 has been used to scroll to the proper choice, the user can select a specific option, such as "casserole."

Next, sub-selections may need to be made. These are also made using the inner wheel 12. The screen 62 of the interface 60 prompts the user for the next entry. In the "casserole" example, relevant cooking parameters examples could be whether the casserole is fresh or frozen, whether it is a meat casserole or a vegetable casserole, etc.

Figure 6A:
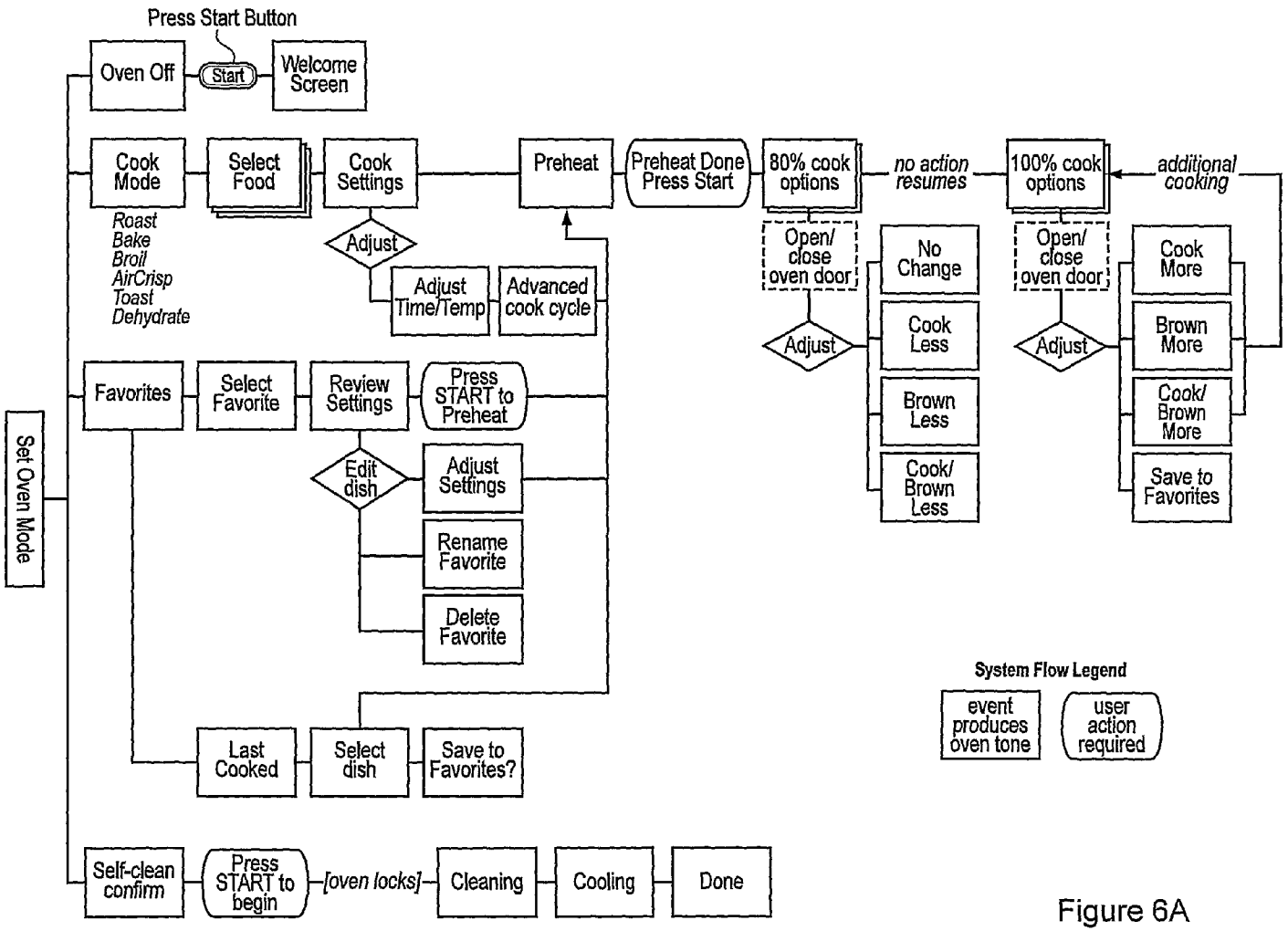
FIGS. 6A and 6B show a decision tree that can be preprogrammed into a multi-energy source oven.
Figure 6B:
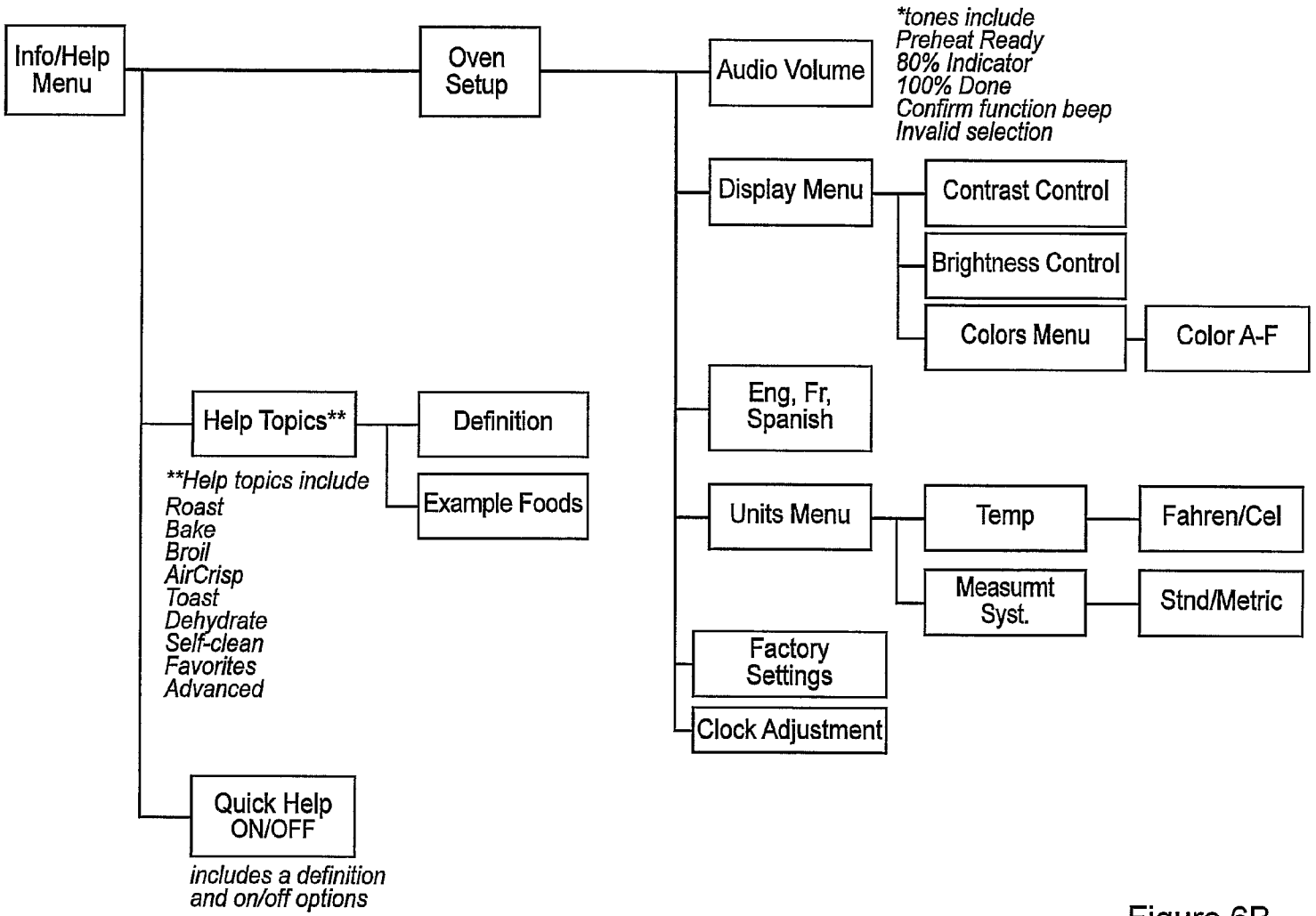

Examples of these "level one" choices, "level two" choices, and related sub-selections are shown in FIGS. 5A-5C. These are only examples, and it should be understood that any form of layered logic may be applied. FIGS. 6A and 6B show a decision tree that can be pre-programmed into the oven 70. These figures illustrate just one embodiment of the prompts that may be followed.

Figure 7A:
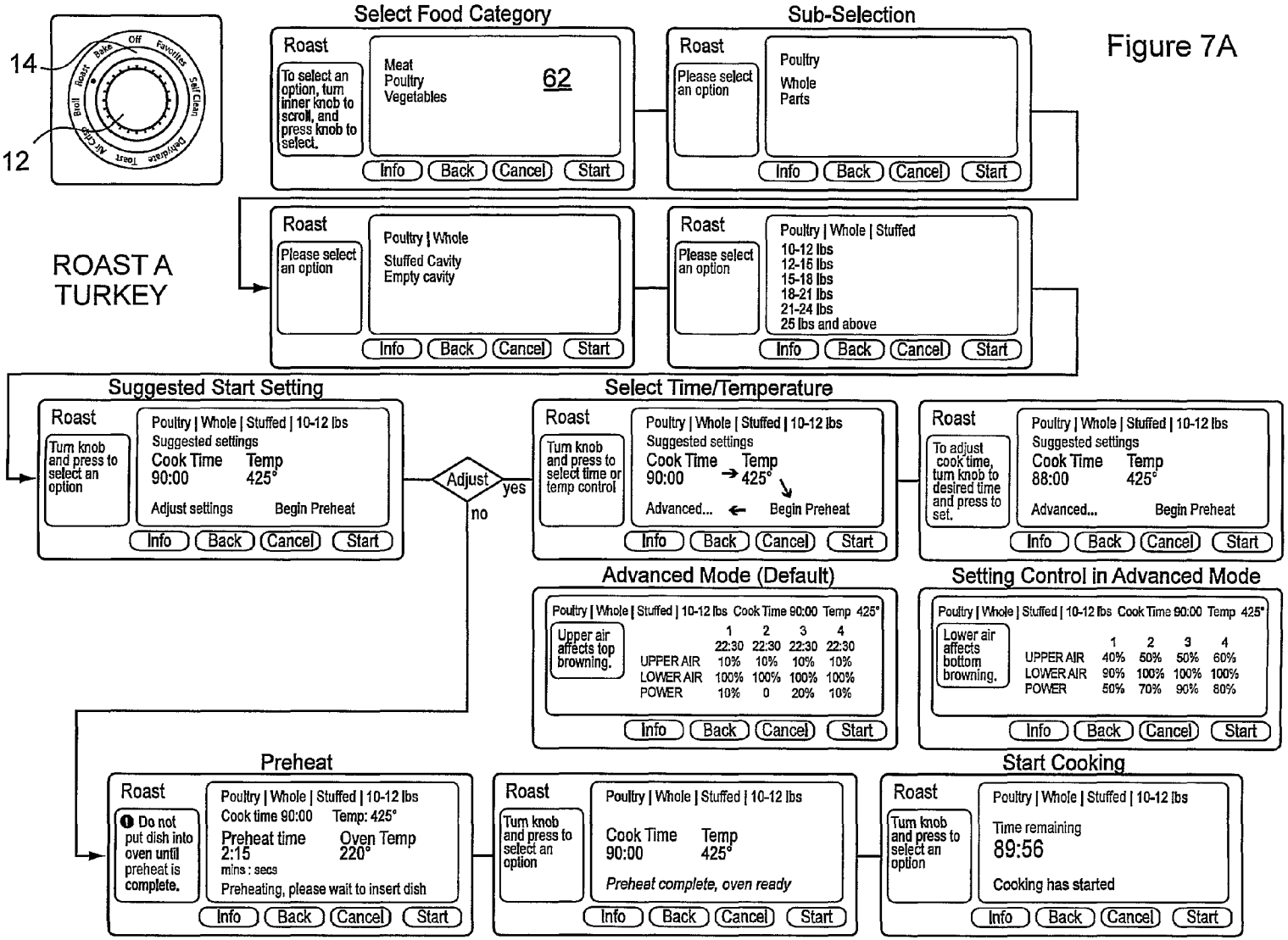
FIG. 7A shows an example of the programming process according to one embodiment of the present invention.

If the user interface 60 is used with an oven, the screen 62 illustrates and prompts the user through the cooking selections to be made, as shown in FIG. 7A. In this example, the user has decided to roast a turkey. The "level one" choice is "roast." The outer wheel 14 is turned to "roast." This "level one" selection causes the oven to begin to pre-heat. This is advantageous to facilitate quick preparation of the oven for cooking. The user will then need to make a "level two" choice, in this case, what type of food will be roasted. The inner wheel 12 is turned until "poultry" is selected on the screen 62, and the inner button 16 or the inner wheel 12 is depressed to mark the selection made. The user will then need to make a series of "sub-selections", for example, "whole/parts," "stuffed cavity/empty cavity" and the weight of the turkey. For each sub-selection, the inner wheel 12 is turned to the select or highlight the desired option so that the cursor on the screen scrolls over the option, and the inner button 16 or the inner wheel 12 is depressed to mark the selection made. (The term "scroll" is intended to relate to moving displayed data across a viewing area on a display screen. There may be a cursor that highlights various options or the options may scroll one by one across the display screen. When the viewing area is full, a new line of data will be brought into the screen, and the oldest, unselected data, will move over one position and eventually move out of the viewing area. The speed at which the wheel is rotated guides the speed at which the data scrolls, although this may be adjustable.)

Figure 12:
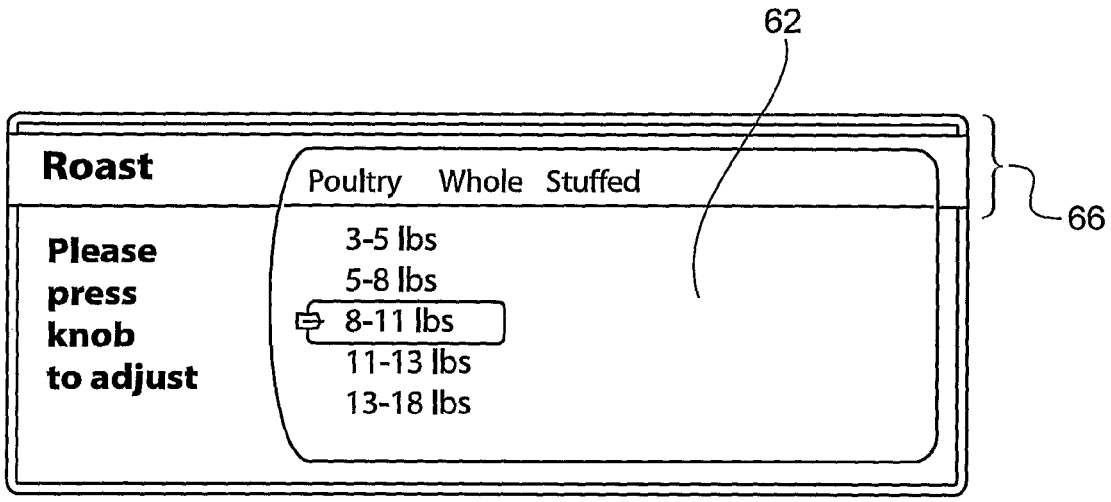
FIG. 12 shows a screen that indicates the settings that have already been selected.

Once all cooking parameters have been entered (e.g., poultry/whole/stuffed/11-13 lbs.), the oven displays suggested start conditions (e.g., one or more of temperature, time, air velocity, microwave power). As a side note, the cooking parameters are preferably listed at the top 66 of the screen 62 to let the user see what previous selections have been made, as shown in FIG. 12. This may be referred to as a "breadcrumbs function," because it lets the user see his or her "trail."

Referring back to FIG. 7A, the suggested start setting that the oven 70 has provided in this example is a cook time of 90 minutes at 425°. If the user decides to accept the oven's suggested settings, the oven will display the amount of time left to pre-heat and will instruct the user when the oven has been pre-heated (by a tone and/or by flashing a message on the screen 62, by the backlighting of the wheels blinking, or any other notification method). Once the food item is placed into the oven, the user presses "start" and the cooking process begins.

Figure 7B:
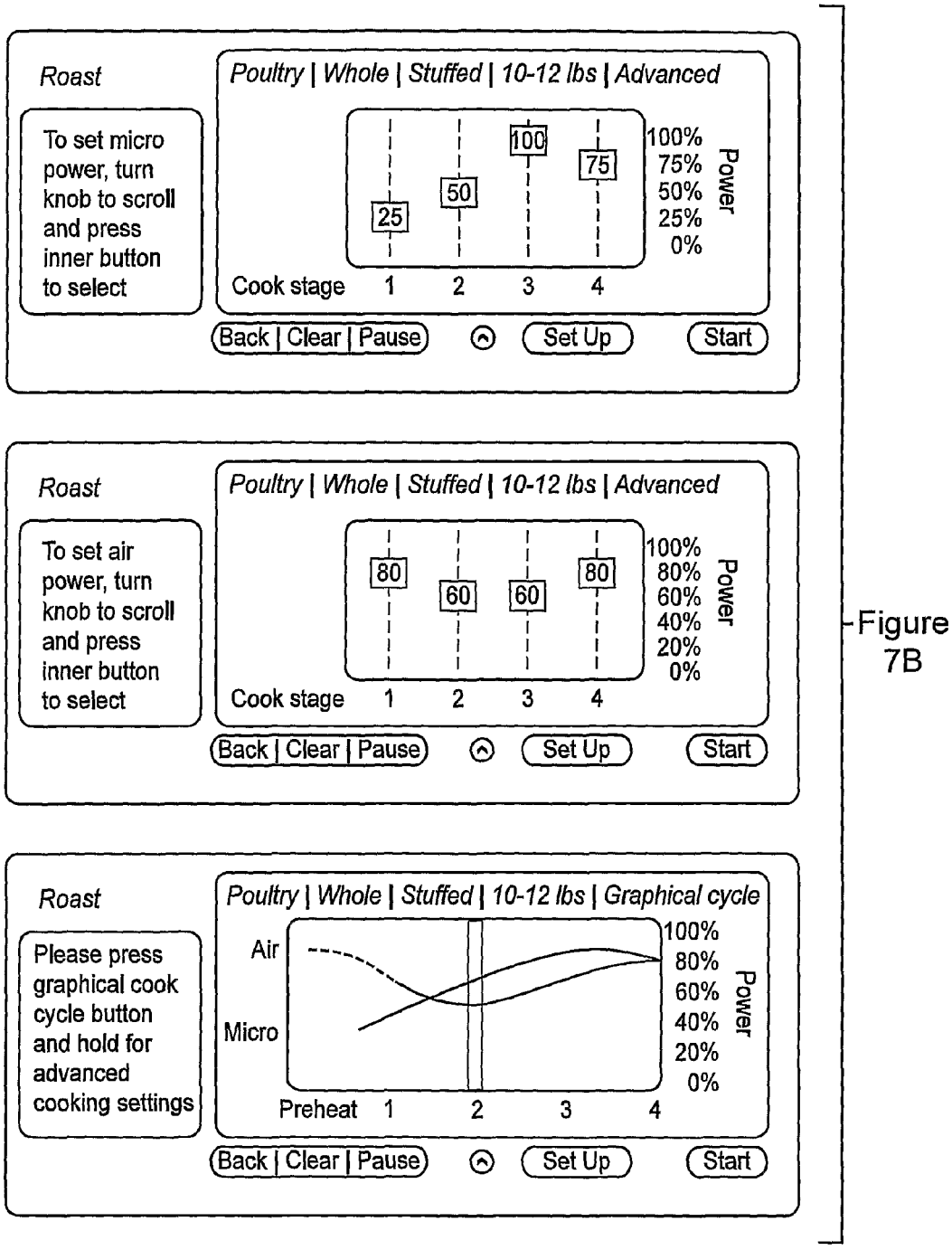
FIG. 7B shows an example of advanced programming options.

If, however, the user decides not to accept the oven's suggested settings, the time, the cooking temperature, and type of cooking may be modified. For example, the temperature and air velocity of the upper air and lower air jets may also be modified. The user may also change the microwave power. This is shown by FIG. 7A, and even more specifically in FIG. 7B.

Figure 9:
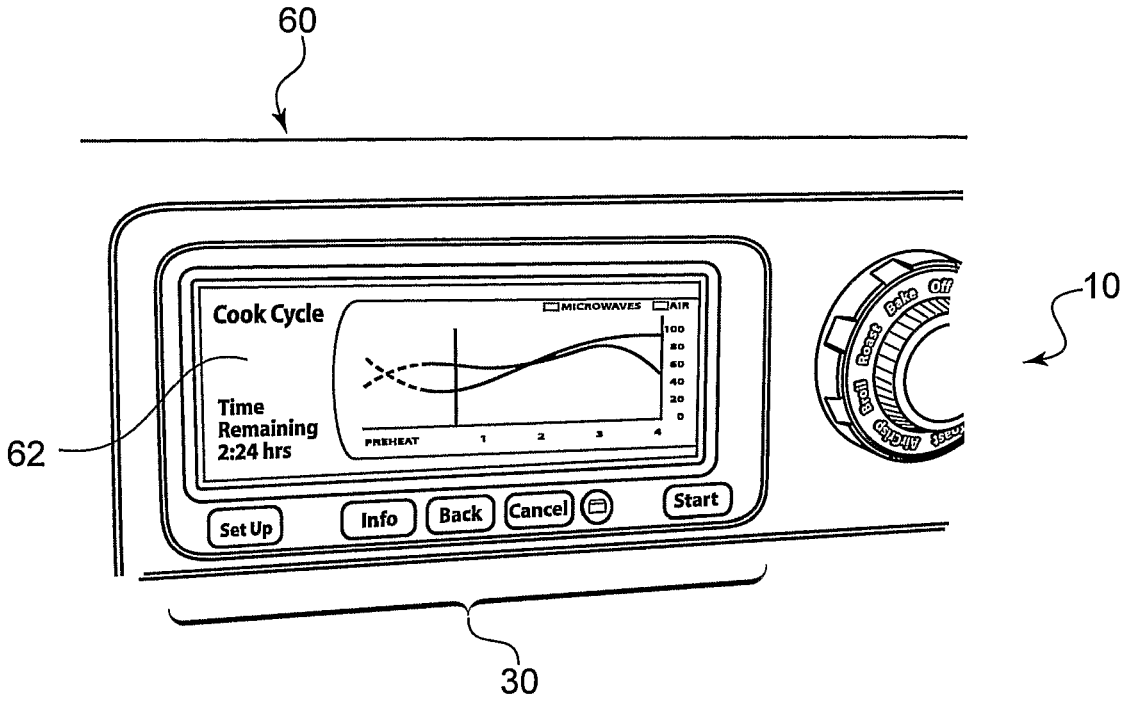
FIG. 9 shows a user interface and hard buttons according to one embodiment of the present invention.

The screen 62 preferably displays the cook cycle stages, the oven power, and the timing. A hard button enables access to this screen. (Examples of a hard buttons 30 can be seen in FIG. 9—they are the buttons below the interface 60. The exemplary hard buttons 60 shown are "info," "back," "cancel," and "start," although any other options may be provided. It is also possible for the commands delivered by hard buttons to be delivered by controller 10, although it may be more user-friendly to provide the suggested hard buttons 60.) In another embodiment, however, the user may turn and push the inner knob to highlight, select, and adjust settings. This may allow the user to make specific incremental adjustments, e.g., the specific air powers for a particular cook cycle, change to microwave power, and so forth.

Figure 8:
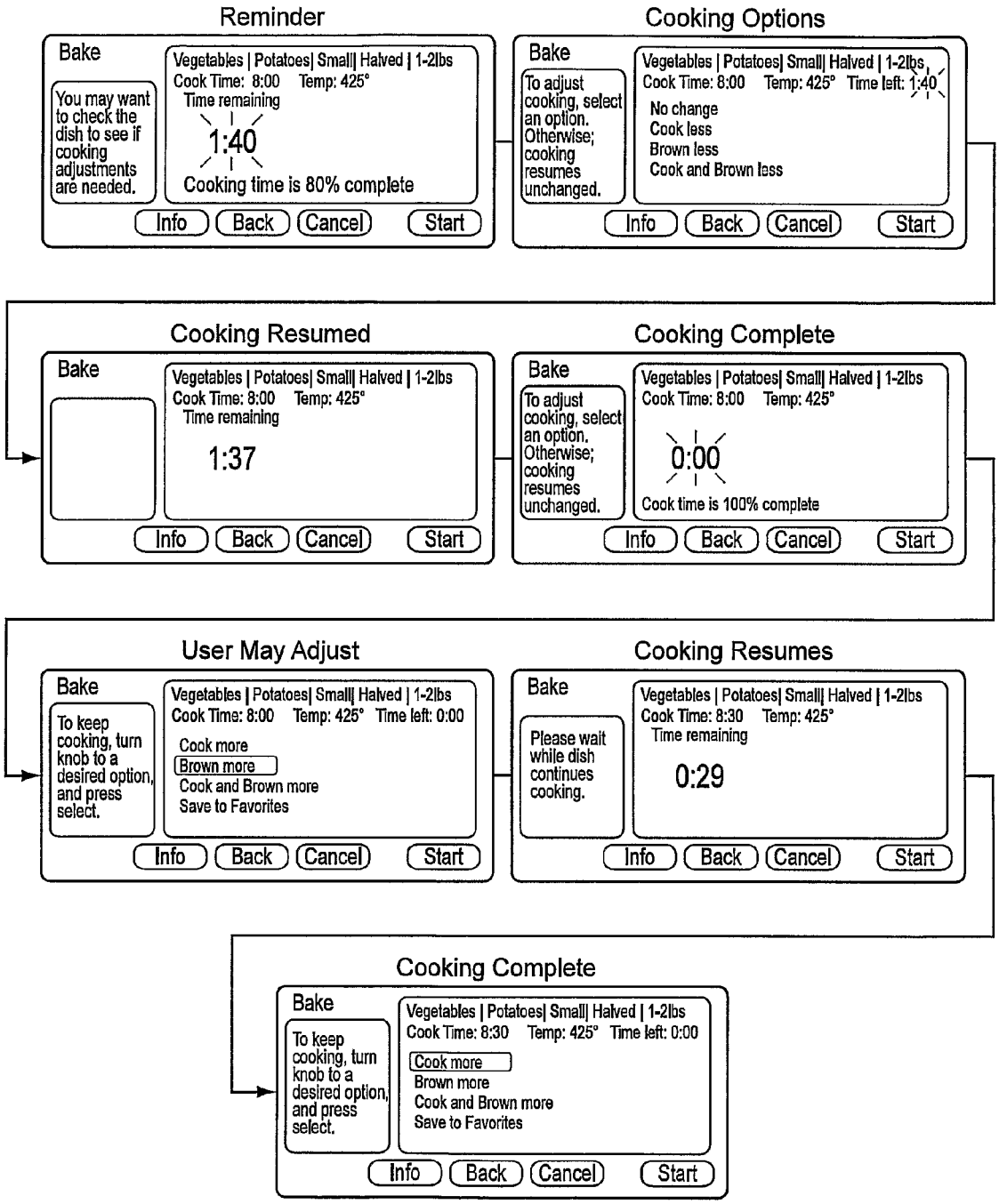
FIG. 8 shows an example of mid-cooking adjustment options.

FIG. 8 shows the mid-cooking adjustments that are possible. In a preferred embodiment, the oven sounds a tone and/or flashes at the 80% mark in the cooking process, although it could be at any time nearing the end of the cooking cycle. (It may also be possible for the user to set the mid-cooking adjustment time desired.) The time remaining to cook may flash, indicating to the user that it would be good time to check the cooking progress. If the user does not activate the controller 10 or open the door to indicate that the food will be checked or a change may be made, the screen times out after a certain period of time and the cooking continues.

If the user activates the controller or opens the door to indicate that the food will be checked, the oven pauses. (The oven also preferably pauses whenever the door is opened.) The user will then have the option to use the controller to make an adjustment selection, e.g., "no change," "cook less," "brown less," or "cook and brown less." ("Cook/Brown more" options are not needed at this point because the cooking has not been completed.)

Once the cooking has been completed, the screen will present the user with another opportunity to check the food while the oven pauses. The options of "cook more," "brown more," "cook and brown more," "done cooking," and "save to favorites" (described more below) will be offered. If more cooking needs to take place, the user uses the controller 10 to select the appropriate changes to be made and presses start. It is preferred that the additional time left to cook during the adjustment cooking time period be displayed on the screen 62. Once the cooking is completed, the user will be notified, and again, presented with adjustment options until the dish is cooked to the user's satisfaction. In other words, following the completion of a cooking operation performed based on the programming that is input by the user, the user can still provide for additional cooking to satisfy personal preferences.

Figure 11:
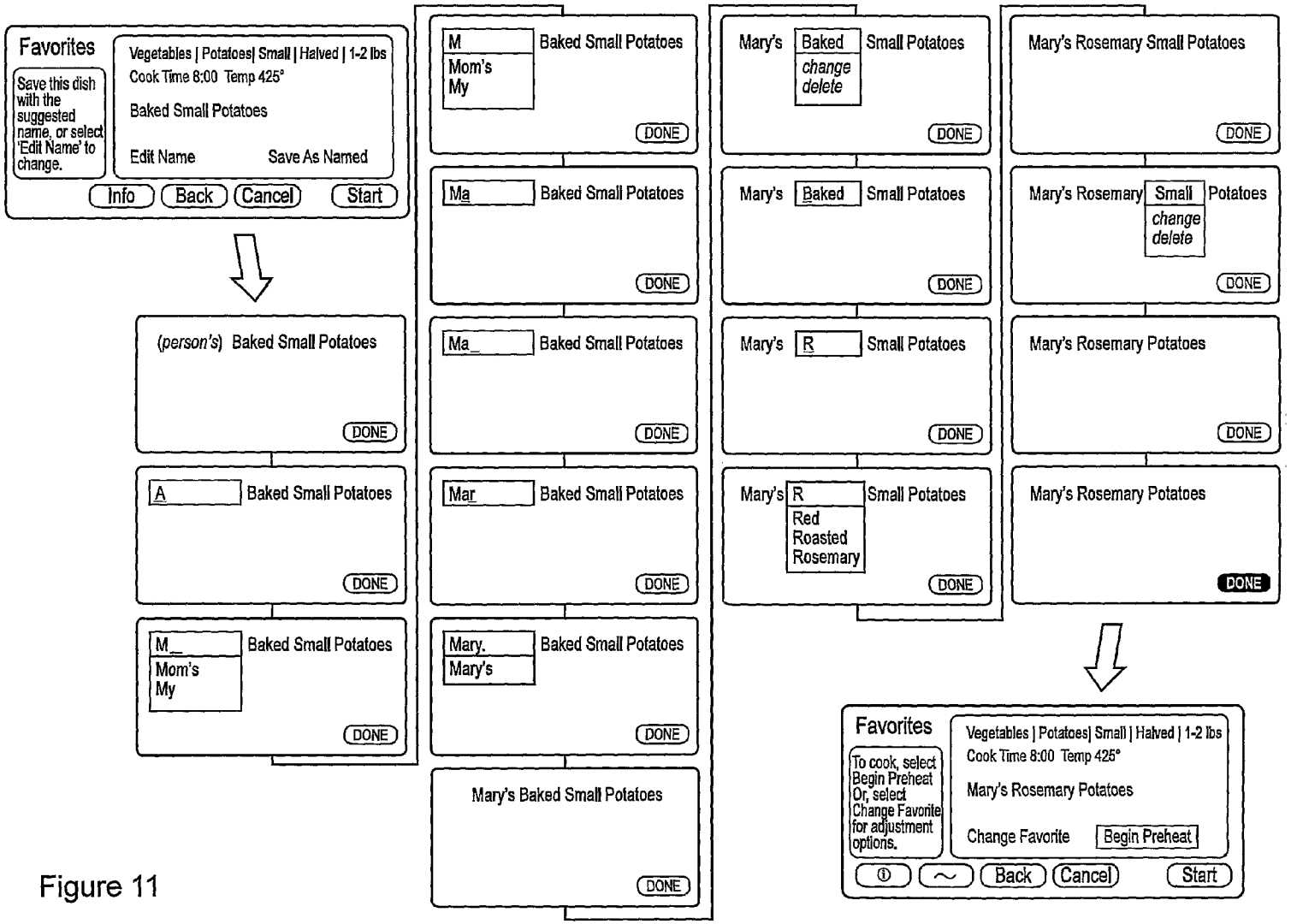

Once the cooking has been completed, the user has the option to save the cooking parameters by selecting "save to favorites" from the completion screen. This causes the oven to record the cook settings used, including any adjustments that were made, and allow the user to enter a name to save those parameters. (One embodiment of a screen for saving favorites is shown in FIG. 10 and another is shown in FIG. 11.) The user may then use these parameters by making a level one choice the next time the oven is used by turning the outer wheel 14 to "Favorites" and using inner wheel 12 to select which favorite setting should be used. In this way, a favorite cooking sequence can be selectively saved as a recipe to be followed in subsequent cooking operations. This process is shown in FIG. 10.

FIG. 10 also shows that if no favorites have been saved, the last ten meals (or any other number—in some embodiments, the user may wish to identify specific numerical preferences) that were cooked will be reflected at the level two choice from the "Favorites" station. If the user has saved favorites, those will be individually reflected under the "level two" choice and the "Last Cooked" meals may be selected and the last cooked parameters will be reflected as a sub-selection.

Another optional feature is to provide an oven 70 that can download data (e.g., from a manufacturer's website, from recipe websites, and so forth) about how the ovens are used (either for information-gathering purposes or for feedback as to which recipes consumers are having to alter most frequently). Other potential information downloads could include new recipes that are being created by other users (or by the oven manufacturer) and the recommended cooking parameters for a multi-energy source oven. Further download options could be cooking parameters for rare or exotic foods that are not in the factory settings. It may also be possible for users to upload their "favorites" settings to a personal link or internet location in the event that they need to replace their oven or are having it repaired. This will ensure that the "favorites" are not lost and they can be downloaded to the new or repaired oven. Users may also wish to share their "favorites" with other consumers and could upload and download them at a recipe sharing site. Uploads and downloads may also be accomplished by using a disc and a disc drive on the oven.

One popular communication technique is to "sync" electronic devices, that is, to transfer information from one device to another device in close proximity. If this option is desired for multi-energy source ovens, they may be provided a data card that contains the information from one oven that can transfer to and receive information from another card of another oven.

Although the above multi-modality controller 10 has been described for use with a cooking appliance such as an oven, it should be understood that it may have applicability in connection with other electronic devices. For example, a multi-modality controller may be useful in programming exercise equipment, such as a treadmill. The level one choice and wheel could relate to the type of exercise desired (e.g., start slow and speed up, steady run, steady walk, incline run, incline walk, etc.). The level two choice and wheel could identify sub-categories, e.g., if a chooser selects incline run, the level two options could be "steady incline," "increasing incline," or "decreasing incline." The next sub-selections to be made could be the level of incline desired, how long the user wishes to exercise, and so forth. Particularly if the treadmill is for personal use, the exercise regimen could be saved as a "Favorite" for next time, as described above. It is also possible for the treadmill or other equipment to check in with the user at a time during the exercise, e.g., at the 80% mark, to see how the user is feeling, to take a heart rate and give feedback, to ask whether the user wishes to exercise beyond the set time, and so forth.

It should also be understood that the multi-modality controller described above may be used in any other number of applications, for example with a juke box, in which the level one choice is what type of music the user wishes to hear (jazz, blues, rock, reggae, R&B, classical, oldies, country, etc.), the level 2 choices are artists, and the sub-selections to be made are songs or albums. In fact, any time that a series of choices is to be presented to the user and the level two choice is a subset of a level one choice, the multi-modality controller described herein may be used. The fact that a specific use has not been described in no ways implies that it is not a potential candidate for the selection systems described herein.

Changes and modifications, additions and deletions may be made to the structures and methods recited above and shown in the drawings without departing from the scope or spirit of the invention and the following claims.

What is claimed is:

1. A multi-modality controller, comprising:

(a) a first selector wheel for making a level one choice which comprises selecting a cooking method, (b) a second scroll wheel for making a level two choice and optional sub-selections that fall within certain categories that relate to the level one choice of a cooking method, the first selector wheel and the second scroll wheel being nested, with the first selector wheel circumscribing the second scroll wheel, with both wheels being independently rotatable about a central axis; and wherein the second scroll wheel is configured to be depressed in order to make one or more selections.

2. The multi-modality controller of claim 1, wherein the controller is used in connection with an oven.

3. The multi-modality controller of claim 2, wherein the oven is a multi-energy source oven.

4. The multi-modality controller of claim 1, wherein the controller allows access to a user interface.

5. The multi-modality controller of claim 1, wherein the controller is a set of knobs.

6. The multi-modality controller of claim 1, wherein the controller is a set of touch pads.

7. The multi-modality controller of claim 1, wherein the controller is a set of thumb wheels.

8. The multi-modality controller of claim 1, wherein the cooking method comprises bake, roast, broil, air crisp, defrost, reheat, toast, microwave, convection cook, favorites, or self clean.

9. The multi-modality controller of claim 1, wherein the level two choice and optional sub-selections relate to food types, food weights, cooking times, and cooking temperatures.

10. The multi-modality controller of claim 1, wherein the choices are displayed on a user interface that allows the user to see the previous choices that have been made.

11. The multi-modality controller of claim 1, further comprising additional selector wheels.

12. The multi-modality controller of claim 1, wherein at least one of the selector wheels is back lit or glows.

13. The multi-modality controller of claim 1, wherein the first selector wheel is an outer wheel with the second scroll wheel nested within, and wherein the outer wheel has macro-sculpting around its perimeter that echoes with internal detents.

14. The multi-modality controller of claim 1, wherein the second scroll wheel comprises a button with a rubber membrane.

15. A method of interfacing with a user and a rapid cooking oven that uses more than one heating source, comprising:

(a) providing a first controller that identifies a series of cooking modes that allows a user to set the controller to a desired cooking mode;

(b) providing a second controller that allows a user to select a food category that can be cooked using the desired cooking mode;

(c) providing a series of sub-category options that further define the food category selected and that can be selected using the second controller;

(d) providing a recommended cooking time and temperature displayed by the oven that is based upon the desired mode, the food category, and the sub-category options selected, wherein the first and second controllers are coaxial wheels.

16. The method of claim 15, wherein the method of interfacing further comprises downloading or uploading data to or from an internet location.

17. A multi-energy source oven, comprising:

(a) a selection system having (i) a first selector wheel for making a level one choice which comprises selecting a cooking method, (ii) a second scroll wheel for making a level two choice and optional sub- selections that fall within certain categories that relate to the level one choice of a cooking method, the first selector wheel and the second scroll wheel being nested, with the first selector wheel circumscribing the second scroll wheel, with both wheels being independently rotatable about a central axis; and wherein the second scroll wheel is configured to be depressed in order to make selections; and (b) a user interface screen.

18. The multi-energy source oven of claim 17, wherein the selection system can save favorite cooking parameters.

19. The multi-energy source oven of claim 17, wherein the cooking method comprises bake, roast, broil, air crisp, defrost, reheat, toast, microwave, convection cook, favorites, or self clean.

20. The multi-energy source oven of claim 17, wherein the level two choice and optional sub-selections relate to food types, food weights, cooking times, and cooking temperatures.

* * * * *